US006460432B1

(12) United States Patent
Julian et al.

(10) Patent No.: US 6,460,432 B1
(45) Date of Patent: Oct. 8, 2002

(54) SHOWER ARM INSTALLATION TOOL

(75) Inventors: Frank D. Julian, Kansas City, MO (US); Joseph P. Ismert, Kansas City, MO (US)

(73) Assignee: Sioux Chief Manufacturing Co., Inc., Peculiar, MO (US)

( * ) Notice: Subject to any disclaimer, the term of this patent is extended or adjusted under 35 U.S.C. 154(b) by 0 days.

(21) Appl. No.: 10/021,950

(22) Filed: Dec. 13, 2001

(51) Int. Cl.[7] ..... B25B 13/00
(52) U.S. Cl. ..... 81/125.1; 81/120; 81/436
(58) Field of Search ..... 81/125.1, 120, 81/180.1, 121.1, 436, 484, 488

(56) References Cited

U.S. PATENT DOCUMENTS

| | | | | |
|---|---|---|---|---|
| 1,131,035 | A | 3/1915 | Brown | |
| 1,424,178 | A | 8/1922 | Noyes | |
| 1,828,142 | A | 10/1931 | Herdman | |
| 2,320,679 | A | 6/1943 | Taylor | |
| 2,470,309 | A | 5/1949 | Hepp | |
| 4,125,913 | A | * 11/1978 | Lewis | 7/138 |
| 4,716,610 | A | 1/1988 | Therkildsen et al. | |
| 4,894,879 | A | 1/1990 | Therkildsen et al. | |
| 5,237,715 | A | 8/1993 | Bone, III | |
| D347,370 | S | 5/1994 | Runevitch | |
| D363,010 | S | 10/1995 | Parsons | |
| 5,692,416 | A | 12/1997 | Hamblin | |
| D420,557 | S | 2/2000 | Paris | |
| 6,192,529 | B1 * | 2/2001 | Jones et al. | 4/615 |

* cited by examiner

*Primary Examiner*—James G. Smith
*Assistant Examiner*—Hadi Shakeri
(74) *Attorney, Agent, or Firm*—Shughart Thomson & Kilroy P.C.

(57) ABSTRACT

A tool for installing a first end of a bent tubular shower arm into a female threaded receiver is disclosed. The tool comprises a shaft having a diameter sized to fit within the shower arm through a second end thereof. The shaft is preferably bent at an angle which is generally complimentary to the angle of the bend in the shower arm. A first end of the shaft is shaped to engage the interior of the shower arm proximate the bend therein to prevent the tool from rotating relative to the shower arm. A second end of the shaft includes a fork having a pair of prongs separated by a gap sized and shaped to accept a stub out of water supply line extending outwardly from a wall. The prongs are used to push a compression fit adapter along the stub out and into an installed position adjacent the wall.

16 Claims, 3 Drawing Sheets

SHOWER ARM INSTALLATION TOOL

BACKGROUND OF THE INVENTION

1. Field of the Invention

This invention relates to a tool for turning a shower arm in threaded engagement with a supply pipe. Optionally, the tool may include a forked end for installing a compression fit shower arm adapter.

2. Description of the Related Art

Shower installations have traditionally been accomplished by extending a vertical supply pipe or tube upward from a shower tap to shower height where it is connected to a drop ear 90 degree elbow fitting which is nailed or screwed securely to a plate positioned within a stud wall. The elbow fitting includes a receiver having ½ inch female N.P.T. ("National Pipe Thread") threads which faces toward the shower room ready to receive a male threaded shower arm. The shower arm is typically a 6" to 8" length of pipe threaded ½" N.P.T. at both ends and bent roughly 45 degrees in the middle. Shower arms are commonly made of thin wall brass tubing plated with chrome. A shower head is then threaded onto the outwardly extending end of the shower arm.

In another, more recently developed shower arm installation method, the supply tubing terminates in a length of ½ inch nominal (⅝" O.D.) tubing or "stub out" which protrudes out of the wall. The tubing including the stub out can be copper, brass or stainless steel tube or one of a variety of types of plastic tubing. The stub out is preferably strapped into position at shower height via a simple two hole strap or the like. A specialized adapter such as the WALL NUT™ manufactured by Sioux Chief Manufacturing Co. of Peculiar, Missouri, is then slid onto the protruding stub out until the adapter abuts the wall. The adapter is made of molded plastic and includes an integral metal one-way gripper ring which is configured to allow the adapter to be slid over the stub out but not retracted off of it. The adapter also includes an O-ring held in position by the gripper ring which provides a tight seal against the stub out. Both the gripper ring and the O-ring are held in position within the adapter via a retaining flange which is heat and pressure treated to conform it to a retaining position. The adapter has a ½" I.P.S. ("Iron Pipe Size") front opening with female threads forming a threaded receiver sized to accommodate a standard ½ inch I.P.S. shower arm or a special nipple having male threads at each end. The adapter further includes an integral ferrule within the threaded receiver which compression seals a shower arm as it is threaded into the adapter. Once the adapter is pushed into position against the wall, it holds the stub out securely into position and prevents the stub out from being pushed backward into the wall. The in-wall bracketing prevents any forward movement of the stub out. Any excess length of the stub out extending beyond the adapter into the shower room can then be cut off just past the end of the adapter.

Due to the thin wall construction of a standard ½" I.P.S. brass shower arm, the stub out can be received within such a shower arm. The shower arm is thus placed over the remainder of the stub out and threaded into the adapter, placing it in a sealing position between the threaded receiver and the integral ferrule. The adapter can be rotated about the stub out to allow the shower arm to be positioned at the desired orientation. The adapter includes a housing with a base flange which includes radially extending fingers which are flexible and discontinuous, allowing weep holes for moisture to escape and also allowing an escutcheon plate to be slid onto the shower arm and snapped onto the base flange fingers to cover the adapter and hole. The base flange also securely retains the escutcheon plate in place, preventing it from rattling loose and away from the finished wall. A shower head can then be installed onto the shower arm to complete the installation of the shower head.

In either of the above-described installation methods, the shower arm must be threaded into a receiver and tightened into its final position. The shower arm must be tightened down firmly enough that the joint between the shower arm and receiver will not leak. In addition, the shower arm must sometimes be tightened past the point which would ordinarily be tight enough to prevent leakage so that the proper orientation is achieved (i.e. the shower head must be pointed downwardly).

Because it is desirable that the chrome finish of the shower arm not be marred during installation, it should not be installed using a common pipe wrench or slip-joint pliers, both of which have serrated metal jaws. Previously, various types of strap wrenches and soft jawed wrenches have been used to tighten shower arms, however these wrenches often do not grip securely and, therefore, tend to slip. In addition, U.S. Pat. No. 5,692,416 to W. C. Hamblin, entitled Shower Head Supply Pipe Tool, discloses a specialized tool for use in installing shower arms. The tool has a cylindrical head which is inserted in one end of the shower arm, a hilt to stop the pipe at a predetermined length of insertion, and a straight, elongate handle by which to rotate the shower arm relative to the threads of the receiver. This device would be somewhat awkward to use since the handle would extend outwardly at an obtuse angle to the receiver into which the user is attempting to thread the shower arm, causing the user to rotate the handle in a cone shaped motion.

SUMMARY OF THE INVENTION

The present invention comprises a tool for tightening a shower arm relative to a female threaded receiver which receives a first male threaded end of the shower arm. The tool generally comprises a shaft having a diameter sized to fit within the shower arm through a second end thereof. The shaft has a first shaft end which is adapted to be inserted into the shower arm, and a second shaft end opposite the first shaft end. The shaft is bent at an angle which is generally complementary to the angle of the shower arm. The first shaft end is shaped to conform to the shape of and engage the interior surface of the bend in the shower arm and thereby prevent the tool from rotating relative to the shower arm. As such, the first shaft end includes a tip and is curved longitudinally therefrom in a first convex arc with a radius selected to approximately match the radius of an interior curve of the shower arm bend. The first shaft end is also curved laterally in a second convex arc selected to approximately match an interior radius of the shower arm. When the first shaft end is engaged within the shower arm, the tool is retained in a position relative to the shower arm wherein the portion of the shaft between the second shaft end and the bend is generally perpendicular to the portion of the shower arm located between its first end and bend.

Optionally, the second shaft end may include a fork having a pair of prongs separated by a gap sized and shaped to accept a stub out of water supply line which extends outwardly from a wall. The prongs are adapted to be used to push a compression fit adapter along the stub out and into an installed position adjacent the wall.

DETAILED DESCRIPTION OF THE PREFERRED EMBODIMENT

Figures 1, 1A, 2, 7:
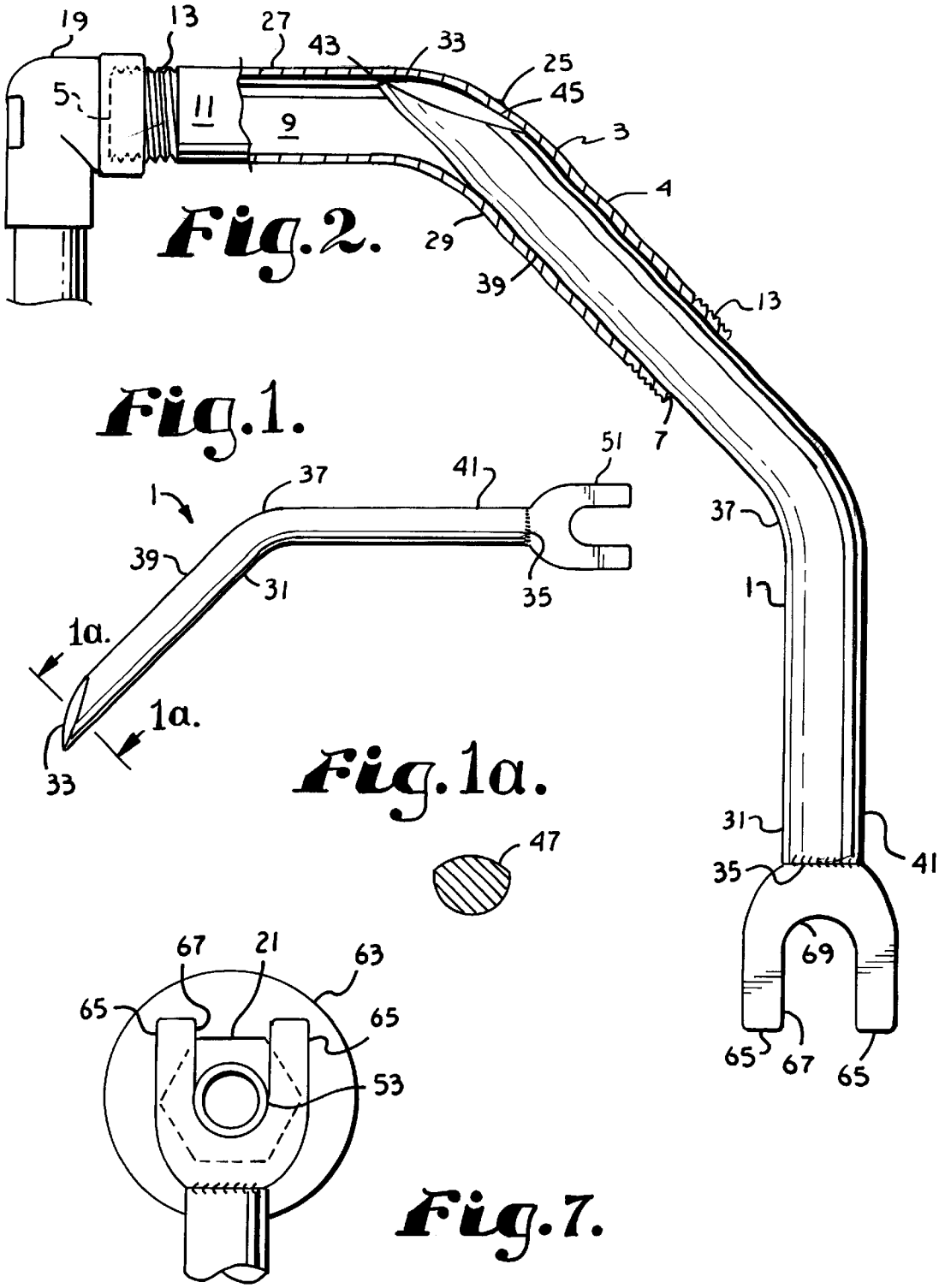
FIG. 1 is a plan view of a shower arm installation tool embodying the present invention.
FIG. 1*a* is a cross sectional view of the tool taken generally along line 1*a*—1*a* in FIG. 1.
FIG. 2 is a side view of a shower arm installation showing use of the tool of FIG. 1 to install a shower arm into a receiver of a drop ear 90 degree elbow fitting.
FIG. 7 is a fragmentary end view of the shower arm installation of FIG. 6.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 3:
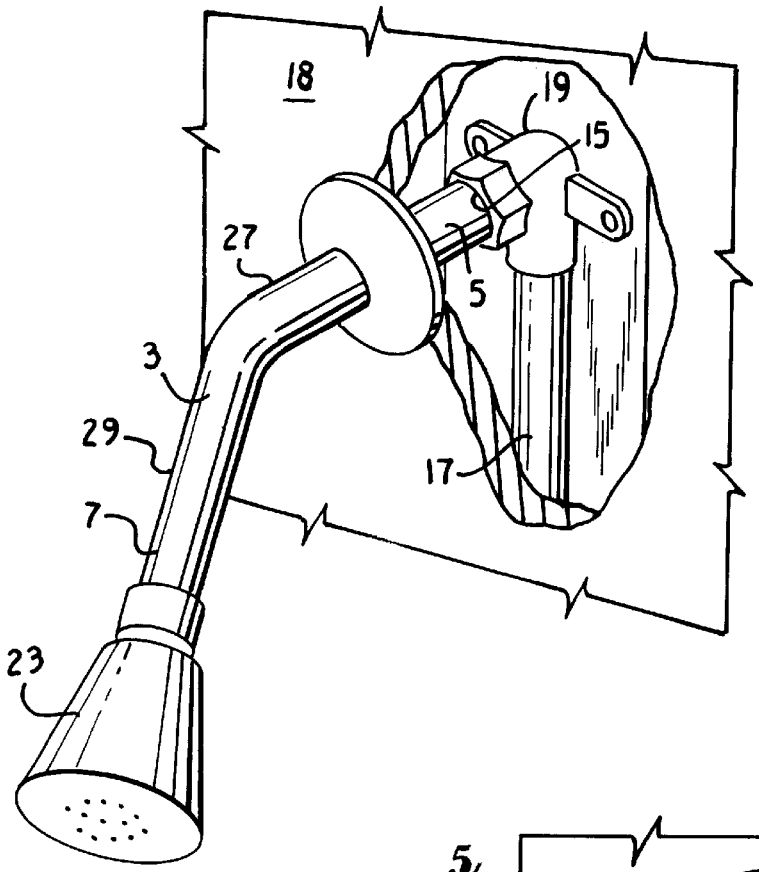
FIG. 3 is a perspective view of a shower arm installation using a drop ear 90 degree elbow fitting.
Figure 4:
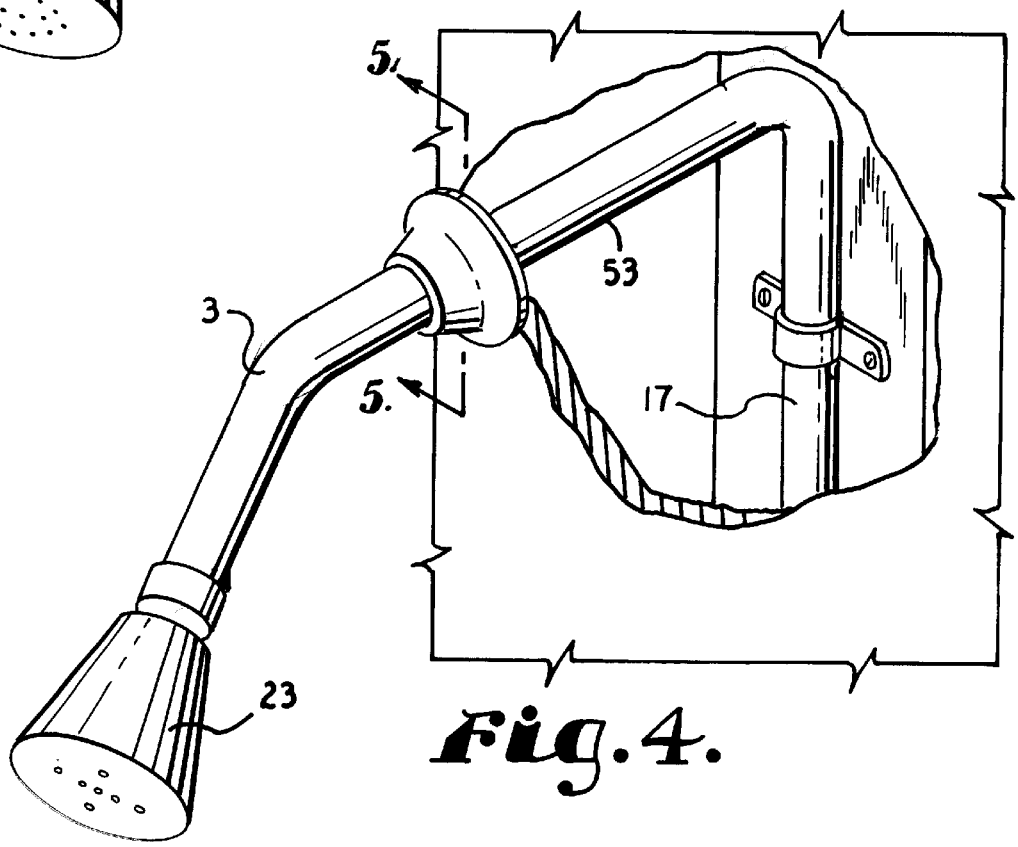
FIG. 4 is a perspective view of a shower arm installation using a compression fit adapter.

Referring to the drawings in more detail, and in particular to FIG. 1, the reference number 1 generally designates a shower arm installation tool embodying the present invention. The tool 1 is designed for use in installing a standard ½" I.P.S. shower arm 3, as best seen in FIG. 2, which generally comprises a 6" to 8" length of thin wall brass tubing 4 having a first end 5, a second end 7, an interior surface 9 and an exterior surface 11. Both the first end 5 and second end 7 have ½" N.P.T. male threads 13. In use, the first end 5 of the shower arm 3 is received by a generally horizontally oriented female threaded receiver 15 in communication with a water supply pipe 17 inside a wall 18. The receiver 15 may be formed in a drop ear 90 degree elbow fitting 19 (FIG. 3), a compression fit adapter 21 (FIG. 5), or any other plumbing fitting suitable to the particular installation. The second end 7 of the shower arm 3 threadably receives a shower head 23. The shower arm 3 has a bend 25 between the first end 5 and second end 7 such that, when properly installed, the second end 7 angles downwardly roughly 45 degrees from the first end 5. A first section 27 of the shower arm 3 extends from the first end 5 to the bend 25, and a second section 29 of the shower arm 3 extends from the bend 25 to the second end 7.

Because the shower arm 3 is exposed to view after installation, its exterior surface 11 is often provided with a decorative coating which is commonly chrome plating, but may even be gold or other precious metal plating in more elegant applications. It is important, therefore, that the exterior surface 11 not be marred or otherwise damaged during installation of the shower arm 3. For this reason, the tool 1 is designed to engage only the interior surface 9 of the shower arm 3, and not the exterior surface 11.

Referring again to FIG. 1, the tool 1 is preferably made of steel, though it is foreseen that other materials such as brass, aluminum, or high strength plastics could also be used. The tool 1 generally comprises a shaft 31 having a first end 33, a second end 35, and a bend 37 between the first and second ends. The shaft 31 is sized roughly ⅝" in diameter so as to be receivable within the shower arm 3 through the second end 7 thereof. A first leg 39 of the shaft 31 extends from the first end 33 to the bend 37, and a second leg 41 of the shaft 31 extends from the bend 37 to the second end 35. The length of the first leg 39 is selected to be long enough to allow the first end 33 of the shaft 31 to extend into the bend 25 of the shower arm 3 when the tool 1 is fully inserted into the shower arm 3. The second leg 41 will serve as a handle by which the user will turn the shower arm 3 and is of a length selected to provide sufficient leverage to accomplish the task without interference with nearby structures such as the walls or ceiling of the shower enclosure.

Referring to FIG. 2, the bend 37 is at an angle selected to be approximately complementary to the angle of the bend 25 in the shower arm 3 so that when the first leg 39 of the shaft 31 is inserted into the second section 29 of the shower arm 3, the second leg 37 will be placed at a right angle to the first section 27 of the shower arm 3. This right angle orientation of the second leg 37 to the first section 27 of the shower arm will allow the user to turn the second leg 37 in a single plane while tightening the shower arm 3. Because the angle of the bend 25 of a standard shower arm 3 is roughly 45 degrees, the angle of the bend 37 of a tool 1 designed to install such a shower arm 3 will also be 45 degrees. (As used herein, the "angle of a bend" is the angle at which the respective tube, shaft, etc. deviates from a straight line, and not the resultant included angle.)

The first end 33 of the tool 1 is shaped to conform to and engage a portion of the interior surface 9 of the bend 25 of the shower arm 3 so as to prevent the tool 1 from rotating relative to the shower arm 3. To such end, the first end 33 includes a bluntly pointed tip 43 and is curved longitudinally therefrom in a convex arc 45 selected to approximately match the interior curve of the bend 25 in the shower arm 3. In addition, the first end 33 is curved laterally in a convex arc 47 selected to approximately match the interior radius of the tubing 4 (see FIG. 1*a*). The resulting shape is that of a flattened dome surface 49 which angles inwardly from the tip 43.

Figure 5:
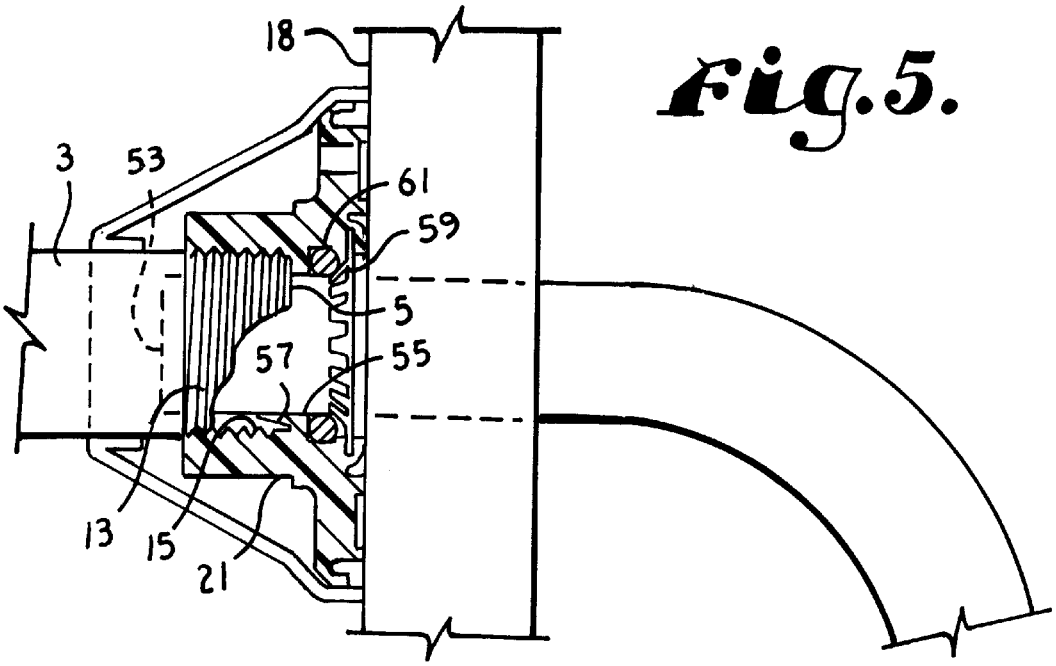
FIG. 5 is an enlarged, fragmentary cross section of the shower arm installation of FIG. 4 taken generally along line 5—5 in FIG. 4.

Optionally, the tool 1 may incorporate a fork 51 connected to the second end 35 of the shaft 31 which is used to push a compression fit adapter 21 into position on a stub out 53 of the supply pipe 17. As generally shown in FIG. 5, such adapters 21 include a central opening 55 sized to receive the stub out 53 with an integral ferrule 57 positioned therein. The threaded receiver 15 is positioned concentrically with the ferrule 57 such that as the shower arm 3 is tightened into the receiver 15, the first end 5 of the shower arm 3 engages the ferrule 57 and compresses it against the stub out 53, sealing the joint. The adapter 21 may further be equipped with a metal one-way gripper ring 59 which is configured to allow the adapter 21 to be slid over the stub out but not retracted off of it. An O-ring 61 may be held in position by the gripper ring 59 to provide a tight seal against the stub out 53. When installing an adapter 21, it must be slid onto the stub out 53 and pushed along the stub out 53 until a base flange 63 of the adapter 21 engages the wall 18. Because the ferrule 57, gripper ring 59 and O-ring 61 all must fit tightly against the stub out 53, they collectively provide some resistance to sliding the adapter 21 along the stub out 53. It is, therefore, useful to have a tool such as the fork 51 for pushing the adapter 21. The fork 51 includes a pair of prongs 65 positioned on opposite sides of a gap 67 sized to receive the stub out 53 and having a closed end 69 curved to generally match the outer circumference of the stub out 53.

Figure 6:
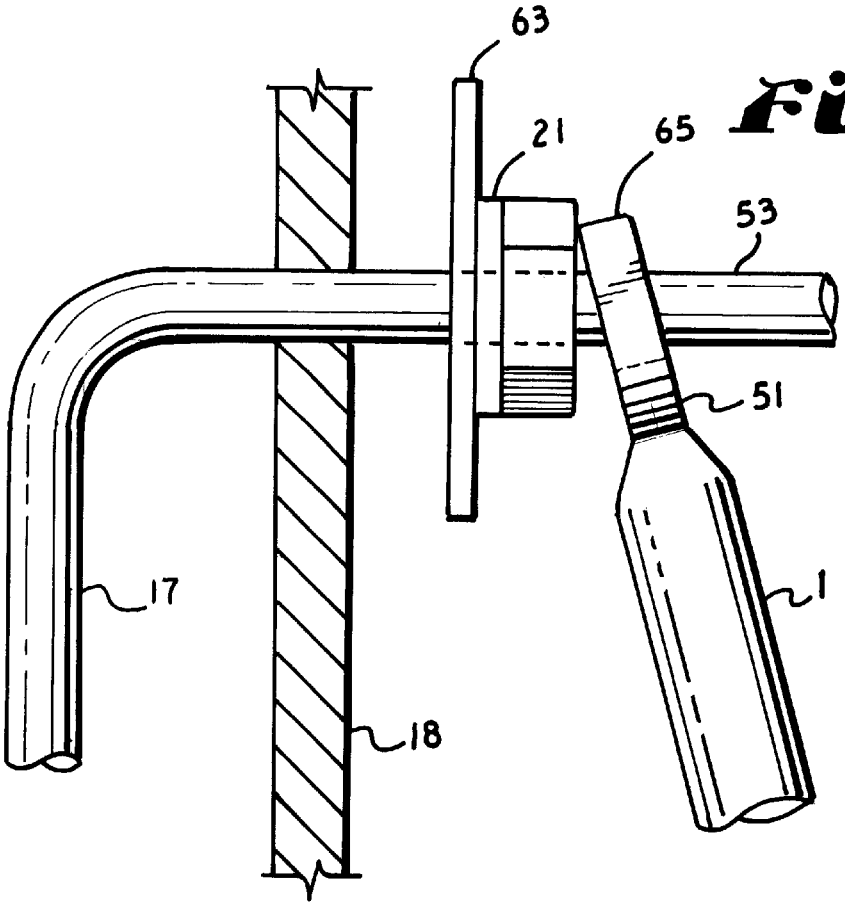
FIG. 6 is a fragmentary side view of a shower arm installation showing use of the tool of FIG. 1 for installing a compression fit adapter on a plumbing stub out.
Figures 1, 1A, 2, 7:
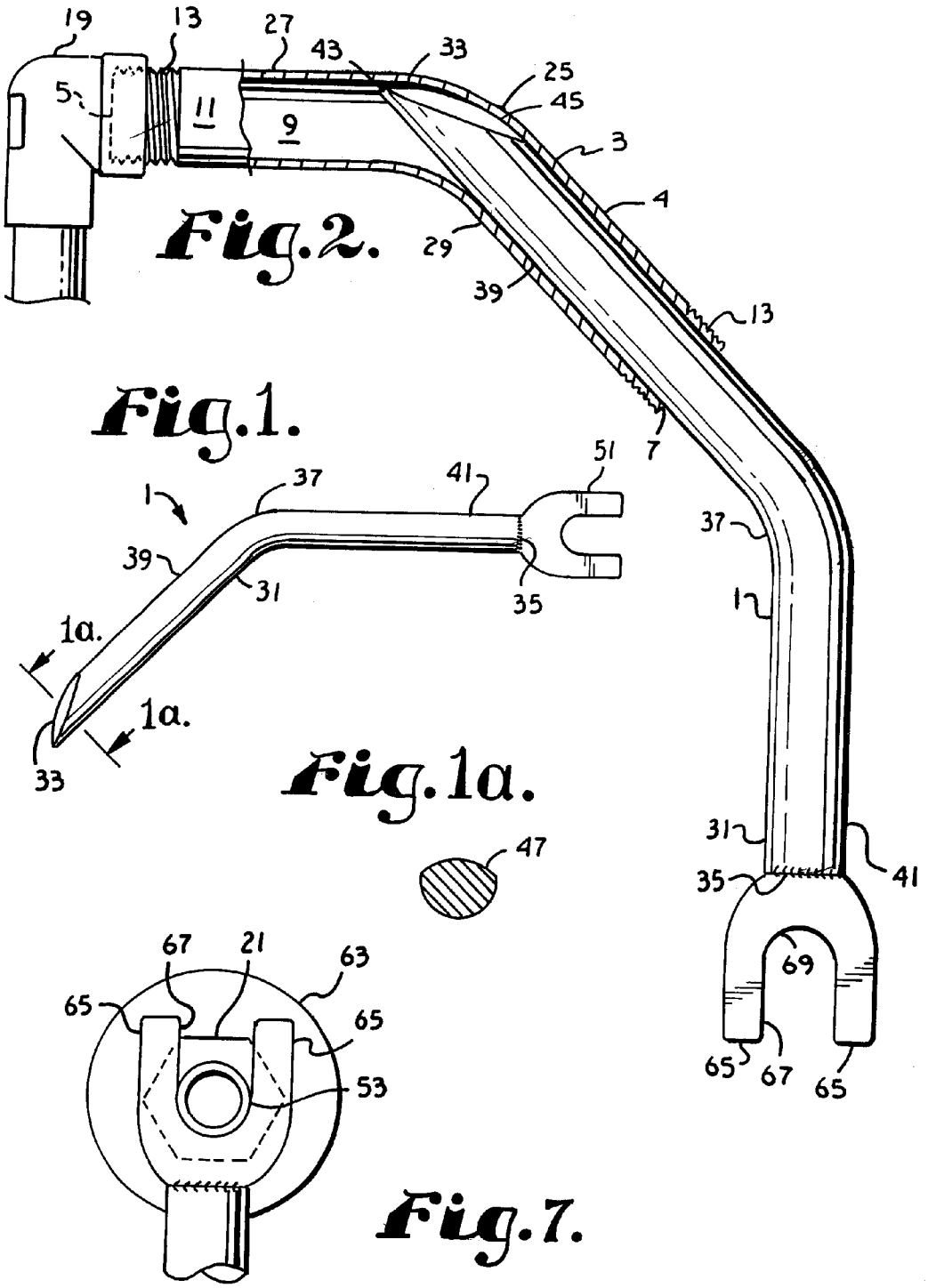

In use, if an adapter 21 is being used, the person installing the shower arm 3 first starts the adapter 21 onto the stub out 53 by inserting the stub out 53 into the cental opening 55 of the adapter 21. The installer then uses the fork 51 of the tool 1 to push the adapter 21 along the stub out 53, as shown in FIGS. 6 and 7, by placing the prongs 65 against the adapter 21 on opposite sides of the stub out 53 and urging the adapter 21 toward the wall 18 until the base flange 63 of the adapter 21 engages the wall 18. If necessary, the stub out 53 may be held with a pair of pliers or the like to keep the stub out 53 from being pushed into the wall as the adapter 21 is advanced with the tool 1.

Once the adapter 21 is installed, the installer hand threads the first end 5 of the shower arm 3 into the female threaded receiver 15 of the adapter 21. Alternatively, if a 90 degree elbow fitting 19 or similar plumbing fitting is to be used in place of an adapter 21, the shower arm 3 is hand threaded into the female threaded receiver 15 of the fitting. The installer then inserts the first end 33 of the tool shaft 31 into the shower arm 3 through its second end 7 as shown in FIG. 2. The tool 1 is pushed inwardly and rotated until the first end 33 engages the interior surface 9 of the shower arm 3 proximate the bend 25, preventing further rotation. The installer then uses the tool 1 to tighten the shower arm 3 to its final installed position by grasping the second leg 41 of the tool shaft 31 and rotating the second leg 41 in a flat circular arc perpendicular to the centerline of the receiver 15. The installer stops turning the tool 1 when the joint between the shower arm 3 and the receiver 15 is tight and the second end 7 of the shower arm 3 is pointed generally downwardly. The tool 1 is then removed from the shower arm 3 and the shower head 23 is screwed onto the second end 7 of the arm 3.

It is to be understood that while certain forms of the present invention have been illustrated and described herein, it is not to be limited to the specific forms or arrangement of parts described and shown.

Claims:

1. A tool for tightening a tubular shower arm relative to a female threaded receiver, the shower arm including interior and exterior surfaces, a first end having male threads receivable by the female threaded receiver, a second end, and a shower arm bend between the first and second ends, the shower arm bend being at a first angle, said tool comprising a shaft having a diameter sized to fit within the shower arm through the second end thereof, said shaft having a first shaft end, a second shaft end, and a shaft bend between said first and second shaft ends, said shaft bend being at a second angle approximately complementary to the first angle, said first shaft end being shaped to engage the interior surface of the shower arm proximate the shower arm bend and retain said tool in a position relative to the shower arm wherein a portion of said shaft between said second shaft end and said shaft bend is generally perpendicular to a portion of the shower arm between the first end and the shower arm bend.

2. The tool as in claim 1 wherein said first shaft end includes a tip and is curved longitudinally from said tip in a first convex arc selected to approximately match an inner surface of an outer curve of the shower arm bend, said first shaft end further being curved laterally in a second convex arc selected to approximately match an interior radius of the shower arm.

3. The tool as in claim 1 wherein said second shaft end includes a fork having a pair of prongs separated by a gap, said gap sized and shaped to accept a stub out of water supply line extending outwardly from a wall, said prongs adapted to push a compression fit adapter along the stub out and into an installed position adjacent the wall.

4. A tool for tightening a tubular shower arm relative to a female threaded receiver, the shower arm including interior and exterior surfaces, a first end having male threads receivable by the female threaded receiver, a second end, and a shower arm bend between the first and second ends, the shower arm bend being at a first angle, said tool comprising a shaft having a diameter sized to fit within the shower arm through the second end thereof said shaft having a first shaft end shaped to engage the interior surface of the shower arm proximate the shower arm bend and thereby prevent said tool from rotating relative to the shower arm.

5. The tool as in claim 4 wherein said first shaft end includes a tip and is curved longitudinally from said tip in a first convex arc selected to approximately match an inner surface of an outer curve of the shower arm bend, said first shaft end further being curved laterally in a second convex arc selected to approximately match an interior radius of the shower arm.

6. The tool as in claim 4 wherein said shaft includes a second shaft end and a shaft bend between said first and second shaft ends, said shaft bend being at an angle approximately complementary to an angle of the shower arm bend.

7. The tool as in claim 6 wherein said first shaft end is shaped to retain said tool in a position relative to the shower arm wherein a portion of said shaft between said shaft bend and said second shaft end is generally perpendicular to a portion of the shower arm between the first end and the shower arm bend.

8. The tool as in claim 4 wherein said second shaft end includes a fork having a pair of prongs separated by a gap, said gap sized and shaped to accept a stub out of water supply line extending outwardly from a wall, said prongs adapted to push a compression fit adapter along the stub out and into an installed position adjacent the wall.

9. A tool for installing a tubular shower arm into a female threaded receiver, the shower arm including interior and exterior surfaces first and second ends having male threads and a shower arm bend between the first and second ends, the shower arm bend being at a first angle, said tool comprising a shaft having a diameter sized to fit within the shower arm through the second end thereof, said shaft having a first shaft end, a second shaft end, and a shaft bend between said first and second shaft ends, said shaft bend being at a second angle approximately complementary to the first angle, said first shaft end being shaped to engage the interior surface of the shower arm proximate the shower arm bend and thereby prevent said tool from rotating relative to the shower arm.

10. The tool as in claim 9 wherein said first shaft end includes a tip and is curved longitudinally from said tip in a first convex arc selected to approximately match an inner surface of an outer curve of the shower arm bend, said first shaft end further being curved laterally in a second convex arc selected to approximately match an interior radius of the shower arm.

11. The tool as in claim 9 wherein said second shaft end includes a fork having a pair of prongs separated by a gap, said gap sized and shaped to accept a stub out of water supply line extending outwardly from a wall, said prongs adapted to push a compression fit adapter along the stub out and into an installed position adjacent the wall.

12. A tool for rotating a tubular member about a first end thereof, the tubular member further including interior and exterior surfaces, a second end and a tubular member bend between the first and second ends, the tubular member bend being at a first angle, said tool comprising a shaft having a diameter sized to fit within the tubular member through the second end thereof said shaft having a first shaft end and a second shaft end, said first shaft end being shaped to engage the interior surface of the tubular member proximate the tubular member bend and thereby prevent said tool from rotating relative to the tubular member.

13. The tool as in claim 12 wherein said first shaft end includes a tip and is curved longitudinally from said tip in a first convex arc selected to approximately match an inner surface of an outer curve of the tubular member bend, said first shaft end further being curved laterally in a second convex arc selected to approximately match an interior radius of the tubular member.

14. The tool as in claim 12 wherein said shaft includes a second shaft end and a shaft bend between said first and second shaft ends, said shaft bend being at an angle approximately complementary to an angle of the tubular member bend.

15. The tool as in claim 14 wherein said first shaft end is shaped to engage the interior of the tubular member proximate the tubular member bend and retain said tool in a position relative to the tubular member wherein a portion of said shaft between said second shaft end and said shaft bend is generally perpendicular to a portion of the tubular member between the first end and the tubular member bend.

16. The tool as in claim 12 wherein said first shaft end is shaped to retain said tool in a position relative to the tubular member wherein a portion of said shaft between said shaft bend and said second shaft end is generally perpendicular to a portion of the tubular member between the first end and the tubular member bend.

* * * * *

UNITED STATES PATENT AND TRADEMARK OFFICE

CERTIFICATE OF CORRECTION

PATENT NO. : 6,460,432 B1
DATED : October 8, 2002
INVENTOR(S) : Frank D. Julian et al.

It is certified that error appears in the above-identified patent and that said Letters Patent is hereby corrected as shown below:

The title page should be deleted and substitute therefore the attached title page as shown on the attached page.

Replace sheet of drawings consisting of Figs. 1, 1a, 2 and 7 as shown on the attached page.

Signed and Sealed this

Sixth Day of May, 2003

JAMES E. ROGAN
*Director of the United States Patent and Trademark Office*

(12) United States Patent
Julian et al.

(10) Patent No.: US 6,460,432 B1
(45) Date of Patent: Oct. 8, 2002

(54) SHOWER ARM INSTALLATION TOOL

(75) Inventors: Frank D. Julian, Kansas City, MO (US); Joseph P. Ismert, Kansas City, MO (US)

(73) Assignee: Sioux Chief Manufacturing Co., Inc., Peculiar, MO (US)

( * ) Notice: Subject to any disclaimer, the term of this patent is extended or adjusted under 35 U.S.C. 154(b) by 0 days.

(21) Appl. No.: 10/021,950

(22) Filed: Dec. 13, 2001

(51) Int. Cl.[7] ..... B25B 13/00
(52) U.S. Cl. ..... 81/125.1; 81/120; 81/436
(58) Field of Search ..... 81/125.1, 120, 81/180.1, 121.1, 436, 484, 488

(56) References Cited

U.S. PATENT DOCUMENTS

| | | | | |
|---|---|---|---|---|
| 1,131,035 | A | 3/1915 | Brown | |
| 1,424,178 | A | 8/1922 | Noyes | |
| 1,828,142 | A | 10/1931 | Herdman | |
| 2,320,679 | A | 6/1943 | Taylor | |
| 2,470,309 | A | 5/1949 | Hepp | |
| 4,125,913 | A * | 11/1978 | Lewis | 7/138 |
| 4,716,610 | A | 1/1988 | Therkildsen et al. | |
| 4,894,879 | A | 1/1990 | Therkildsen et al. | |
| 5,237,715 | A | 8/1993 | Bone, III | |
| D347,370 | S | 5/1994 | Runevitch | |
| D363,010 | S | 10/1995 | Parsons | |
| 5,692,416 | A | 12/1997 | Hamblin | |
| D420,557 | S | 2/2000 | Paris | |
| 6,192,529 | B1 * | 2/2001 | Jones et al. | 4/615 |

* cited by examiner

*Primary Examiner*—James G. Smith
*Assistant Examiner*—Hadi Shakeri
(74) *Attorney, Agent, or Firm*—Shughart Thomson & Kilroy P.C.

(57) ABSTRACT

A tool for installing a first end of a bent tubular shower arm into a female threaded receiver is disclosed. The tool comprises a shaft having a diameter sized to fit within the shower arm through a second end thereof. The shaft is preferably bent at an angle which is generally complimentary to the angle of the bend in the shower arm. A first end of the shaft is shaped to engage the interior of the shower arm proximate the bend therein to prevent the tool from rotating relative to the shower arm. A second end of the shaft includes a fork having a pair of prongs separated by a gap sized and shaped to accept a stub out of water supply line extending outwardly from a wall. The prongs are used to push a compression fit adapter along the stub out and into an installed position adjacent the wall.

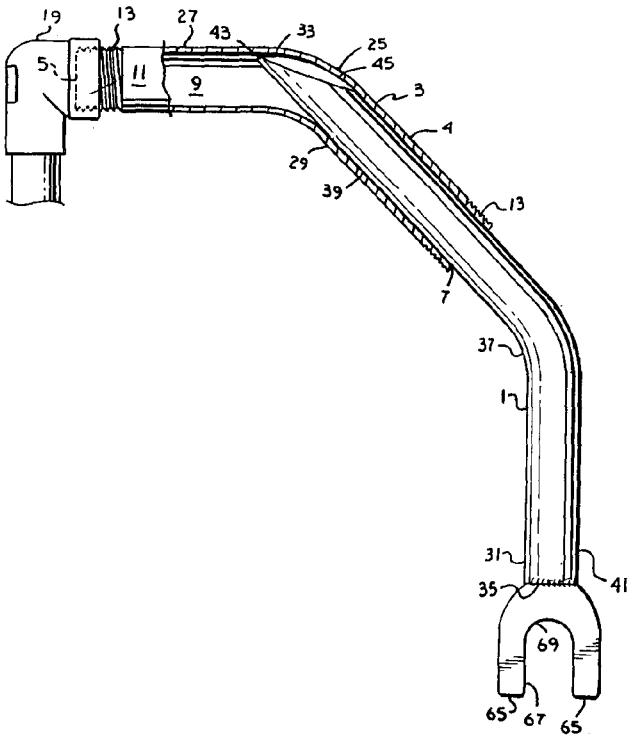

16 Claims, 3 Drawing Sheets